US006368473B1

(12) United States Patent
Furuya et al.

(10) Patent No.: US 6,368,473 B1
(45) Date of Patent: Apr. 9, 2002

(54) SODA ELECTROLYTIC CELL PROVIDED WITH GAS DIFFUSION ELECTRODE

(75) Inventors: Nagakazu Furuya, 6-24-604, Kitsguchi 1-chome, Kofi-shi, Yamanashi 400-0024 (JP); Akihiro Sakata, Tokyo (JP); Koji Saiki, Osaka (JP); Hiroaki Aikawa, Tokyo (JP); Shinji Katayama, Okayama (JP); Kenzo Yamaguchi, Tokyo (JP)

(73) Assignees: Nagakazu Furuya, Yamanashi; Toagosei Co., Ltd.; Mitsui Chemicals, Inc., both of Tokyo; Kaneka Corporation, Osaka; Chlorine Engineers Corp., Ltd., Tokyo, all of (JP)

( * ) Notice: Subject to any disclaimer, the term of this patent is extended or adjusted under 35 U.S.C. 154(b) by 0 days.

(21) Appl. No.: 09/530,110

(22) PCT Filed: Aug. 24, 1999

(86) PCT No.: PCT/JP99/04557

§ 371 Date: Apr. 25, 2000

§ 102(e) Date: Apr. 25, 2000

(87) PCT Pub. No.: WO00/11242

PCT Pub. Date: Mar. 2, 2000

(30) Foreign Application Priority Data

Aug. 25, 1998 (JP) ..... 10-238978
Oct. 13, 1998 (JP) ..... 10-290862

(51) Int. Cl.[7] ..... C25B 9/10

(52) U.S. Cl. ..... 204/263; 204/265; 204/266; 204/261; 204/283

(58) Field of Search ..... 204/263, 265, 204/266, 261, 283

(56) References Cited

U.S. PATENT DOCUMENTS 5,650,058 A 7/1997 Wenske et al. ..... 205/615

FOREIGN PATENT DOCUMENTS

| | | |
|---|---|---|
| JP | 5-271974 | 10/1993 |
| JP | 9-302493 | 11/1997 |
| JP | 10-8283 | 1/1998 |
| JP | 10-110285 | 4/1998 |
| JP | 10-110286 | 4/1998 |
| JP | 10-158877 | 6/1998 |
| JP | 10-158878 | 6/1998 |
| JP | 11-124698 | 5/1999 |

*Primary Examiner*—Bruce F. Bell
(74) *Attorney, Agent, or Firm*—Young & Thompson

(57) ABSTRACT

A sodium chloride electrolytic cell is provided, comprising a gas diffusion electrode that allows smooth supply and discharge of catholyte for electrolyzing sodium chloride and allows oxygen gas to come in good contact therewith. The sodium chloride electrolytic cell comprises an anode chamber having an anode into which an aqueous solution of sodium chloride and a cathode chamber having the foregoing gas diffusion electrode for producing an alkaline aqueous solution, the anode chamber and the cathode chamber being divided by an ion exchange membrane. The sodium chloride electrolytic cell is arranged to effect electrolysis in such a manner that there occurs no pressure differential between the catholyte chamber and the gas chamber in the gas diffusion electrode. Further, a nickel mesh substance is fitted in a concave portion having the same size as that of the gas diffusion electrode formed in the central portion of a thin nickel plate.

6 Claims, 8 Drawing Sheets

SODA ELECTROLYTIC CELL PROVIDED WITH GAS DIFFUSION ELECTRODE

TECHNICAL FIELD

The present invention relates to a sodium chloride electrolytic cell provided with a gas diffusion electrode. More particularly, the present invention relates to a sodium chloride electrolytic cell provided with a gas diffusion electrode which allows smooth supply and discharge of catholyte as well as allows oxygen gas to come in good contact therewith.

BACKGROUND ART

A gas diffusion electrode is normally used as an oxygen electrode for fuel cell or electrolysis of sodium chloride and is internally composed of a gas supply layer and a reaction layer.

The outline of the function and structure of a gas diffusion electrode is described below taking as an example an oxygen cathode to be used as a cathode in the ion exchange membrane process electrolysis of sodium chloride. In general, the ion exchange membrane process electrolysis of sodium chloride involves electrolysis in an electrolytic cell comprising an anode chamber and a cathode chamber divided by a cation exchange member, the anode chamber being provided with an anode and filled with an aqueous solution of sodium chloride and the cathode chamber being provided with a cathode and filled with an aqueous solution of caustic soda. One of these ion exchange membrane process sodium chloride electrolytic cells is an electrolytic cell comprising as a cathode a gas diffusion electrode which supplies a gas containing oxygen, i.e., oxygen cathode. This type of an electrolytic cell comprises a cathode chamber provided with a gas supply chamber and composed of a gas diffusion electrode arranged to supply an oxygen-containing gas onto the cathode therefrom and an electrolytic solution chamber filled with an aqueous solution of caustic soda.

In this arrangement, the use of a gas diffusion electrode arranged to supply an oxygen-containing gas onto the cathode (gas diffusion electrode made of a porous material which supplies an oxygen-containing gas from the gas supply chamber, hereinafter simply referred to as "oxygen cathode") in electrolysis in the electrolytic cell involving energization across the gap between the anode and the cathode gives an advantage that the reduction reaction of oxygen by hydrogen takes place on the oxygen electrode to lower the cathode potential, remarkably lowering the required electrolysis voltage.

The oxygen cathode comprises a thin layer mainly composed of a porous conductor. In the oxygen cathode, the conductor layer is hydrophobic on the gas supply chamber side while the conductor layer is hydrophilic on the electrolytic solution side. Further, the cathode is air-permeable as a whole. Moreover, the cathode is permeable to electrolytic solution on the electrolytic solution side conductor layer. The electrolytic solution side conductor layer in contact with the electrode electrolytic solution, e.g., aqueous solution of caustic soda in the case of electrolysis of sodium chloride, is internally provided with a collector made of a metal gauze.

In general, the foregoing porous conductor is mainly made of carbon black. The porous conductor comprises a catalyst made of a noble metal such as platinum supported thereon in the pores. The oxygen cathode is made of a water-repellent porous thin layer which causes no leakage of electrolytic solution on the oxygen-containing gas supply side thereof. The foregoing water-repellent porous thin layer is normally prepared by forming a mixture of a particulate fluororesin-based polymer resistant to redox reaction and water-repellent carbon black.

The foregoing porous thin layer having such a catalytic activity has an integrated structure obtained by forming a mixture of hydrophobic carbon, water-repellent carbon and particulate fluororesin such that the composition of the layer shows a stepwise change from the hydrophilic surface in contact with the electrolytic solution to the water-repellent porous thin layer on the gas supply chamber side. Accordingly, the porous oxygen cathode can efficiently supply an oxygen-containing gas from the oxygen-containing gas supply side to the side in contact with the electrolytic solution. Further, the electrolytic solution can easily penetrate and diffuse into the electrode from the side in contact with the electrolytic solution but doesn't leak into the gas supply chamber.

Thus, in the presence of sodium ion supplied from the side in contact with the electrolytic solution and the foregoing catalyst, water is oxidized in the oxygen cathode to hydroxyl group, producing caustic soda.

Further, unlike the earlier process of electrolysis of an aqueous solution of sodium chloride free from oxygen cathode involving the production of hydrogen at the cathode, the foregoing electrolysis process using an oxygen cathode is not liable to production of hydrogen, making it possible to lower the electrolysis voltage.

Thus, the outline of the function and structure of the oxygen cathode (gas diffusion electrode arranged to supply an oxygen-containing gas) used in an ion exchange membrane process sodium chloride electrolytic cell has been described. The outline of the function and structure of an ordinary gas diffusion electrode is similar to that described above.

In the case where a gas diffusion electrode is used as an oxygen cathode in the conventional ion exchange membrane type sodium chloride electrolytic cell, a liquid-impermeable gas diffusion electrode is normally used to form a three-chamber structure. In practical sodium chloride electrolytic cells, e.g., vertical electrolytic cell having a height as great as 1.2 m or more, electrolysis is conducted with the electrolytic solution chamber filled with the electrolytic solution. Thus, the gas diffusion electrode is subject to liquid pressure developed by the electrolytic solution at the lower portion thereof. In other words, the liquid pressure on the upper portion of the gas diffusion electrode in the vicinity of the surface of the electrolytic solution in the cathode chamber is closed to atmospheric pressure, but the liquid pressure on the lower portion of the gas diffusion electrode in the vicinity of the bottom of the cathode chamber is the sum of atmospheric pressure and liquid pressure based on the height of the electrolytic solution (liquid head)

When the vertical electrolytic cell is provided with a gas diffusion electrode as oxygen cathode and is then supplied with the electrolytic solution, the gas diffusion electrode is subject to a great liquid pressure at the lower portion thereof but is subject to little liquid pressure at the upper portion thereof, making a pressure differential between the two portions. This pressure differential causes liquid leakage from the catholyte chamber to the gas chamber at the lower portion of the gas diffusion electrode. When the liquid pressure and the gas pressure are adjusted equal to each other at the lower portion of the catholyte chamber to prevent liquid leakage, the gas pressure in the gas diffusion electrode is higher than the liquid pressure at the upper portion of the catholyte chamber, causing the leakage of gas into the electrolytic solution at the upper portion of the gas diffusion electrode.

Further, when operation is conducted with the liquid pressure being higher than the gas pressure, if the gas diffusion electrode is not highly water-resistant and sufficiently sealed, the electrolytic solution leaks into the gas chamber in a large amount, inhibiting the supply of gas and hence deteriorating the electrode performance and life. In particular, the use of a gas diffusion electrode having a low resistance to water pressure is restricted.

As shown in FIG. 11, the cathode chamber in the foregoing conventional electrolysis chamber comprises a sheet-shaped gas diffusion electrode 31 placed on a cathode metal gauze 32 mounted on a cathode chamber frame (not shown). In this arrangement, when a pressure is applied to the gas diffusion electrode 31 at the caustic chamber 33 side thereof, the gas diffusion electrode 31 is pressed against the cathode metal gauze 32 to come in contact with the cathode metal gauze 32 so that it is electrically discharged. At the same time, oxygen is directly supplied into a gas chamber 34 formed between the cathode chamber frame and the gas diffusion electrode 31, and then taken into the interior of the electrode from the back side thereof. In FIG. 11, the reference numeral 35 indicates an ion exchange membrane, and the reference numeral 36 indicates an anode.

However, the gas chamber in the foregoing conventional gas diffusion electrode is preferably configured to comprise existing elements as much as possible to attain economy when this gas diffusion electrode is applied to actual size electrolytic cell. In the case where such a gas diffusion electrode is mounted on a cathode metal gauze as an existing element, the entire space (gas chamber) in the existing cathode element is an oxygen chamber.

On the other hand, the higher the linear rate at which oxygen comes in contact with the oxygen gas diffusion electrode is, the higher is the diffusion rate of oxygen into the electrode.

Accordingly, since the existing element has a thickness of from 40 to 50 mm and hence a great inner capacity, oxygen needs to be supplied in an amount far greater than calculated to give an oxygen gas linear rate required to cause oxygen to be sufficiently diffused into the gas diffusion electrode, giving poor economy. It is also disadvantageous in that even when oxygen is sufficiently supplied, further remodeling is required to give an arrangement such that oxygen flows uniformly to come in uniform contact with the surface of the gas diffusion electrode in the existing element.

SUMMARY OF THE INVENTION

The present invention has been worked out in view of these problems with the conventional techniques. Accordingly, an object of the present invention is to provide a sodium chloride electrolytic cell which allows smooth supply and discharge of catholyte in the electrolysis of sodium chloride using a gas diffusion electrode.

Another object of the present invention is to provide a sodium chloride electrolytic cell comprising a gas diffusion electrode containing a gas chamber for exclusive use, rather containing an existing element as a gas chamber, the gas chamber being provided with a gap allowing a linear rate required to cause oxygen to be sufficiently diffused into the electrode and arranged such that oxygen can come in uniform contact with the gas diffusion electrode.

Then, in order to obtain a sodium chloride electrolytic cell which can attain the foregoing objects, the inventors made extensive studies on the structure of a gas chamber arranged to allow smooth supply and discharge of catholyte and allow oxygen to come in uniform contact with the gas diffusion electrode.

The inventors made extensive studies on solution to the foregoing problems. As a result, the following knowledge was obtained.

The electrolytic solution and oxygen gas are separately supplied into the electrolytic cell at the upper portion thereof in such a manner that the electrolytic solution and oxygen gas show the same pressure to make no pressure differential between on the electrolytic solution chamber side and on the gas chamber side. The electrolytic solution thus supplied is then allowed to flow down. As a result, the catholyte and gas flow down with little or no pressure differential therebetween. Accordingly, the catholyte cannot leak into the gas chamber even in a gas diffusion electrode comprising a gas supply layer having a small resistance to water pressure.

However, when operation is conducted with both the anolyte and catholyte being subjected to atmospheric pressure, the pressure developed by the head of the anolyte presses and brings the ion exchange membrane into contact with the reactive layer in the gas diffusion electrode, occasionally preventing the catholyte from running. It was then found that the foregoing trouble can be effectively prevented by taking an arrangement such that a hydrophilic porous material which is permeable to electrolytic solution, can hold electrolytic solution, is little liable to bubbling and cannot be deformed by the pressure developed by the head of the electrolytic solution and thus cannot cut the passage is provided interposed between the ion exchange membrane and the reactive layer in the gas diffusion electrode.

The inventors made further extensive studies of solution to the foregoing problems. As a result, it was found that the foregoing problem can be solved by providing, as a spacer for securing the passage of oxygen, a nickel mesh substance in a concave gas chamber defined by a cathode frame of thin nickel plate having a concave portion formed by press molding and a gas diffusion electrode. Thus, the present invention has been worked out.

In other words, in the present invention, the foregoing problems can be solved by the following means:

1. A sodium chloride electrolytic cell comprising an anode chamber having an anode into which an aqueous solution of sodium chloride is supplied and a cathode chamber having a cathode comprising a gas diffusion electrode for producing an alkaline aqueous solution, said anode chamber and said cathode chamber being divided by an ion exchange membrane, wherein an electrolytic solution passage is provided between said ion exchange membrane and a reactive layer of said gas diffusion electrode, and wherein a feed opening for said electrolytic solution passage is provided and a feed opening for oxygen gas is provided on an upper portion of a gas chamber of said gas diffusion electrode, through which an electrolytic solution and oxygen gas are separately supplied, so as not to cause pressure differential between said passage and said gas chamber, and then allowed to run downward as descending flow to effect electrolysis.
2. The sodium chloride electrolytic cell according to the above item 1, wherein a hydrophilic structure having open cells and a high porosity is interposed between said ion exchange membrane and said reactive layer of said gas diffusion electrode, and the electrolytic solution is supplied into said electrolytic solution passage having said hydrophilic structure.

3. The sodium chloride electrolytic cell according to the above item 1 or 2, comprising an electrically conductive porous material as a core, which has at least an electrolytic solution passage portion, a reactive layer and a gas supply layer, sequentially and integrally formed from the surface side.
4. The sodium chloride electrolytic cell according to any one of the above items 1 to 3, having a structure such that an electrolytic solution reservoir is provided on an upper portion of said electrolytic cell, a gas phase above a liquid level in said electrolytic solution reservoir and the oxygen gas supplied into said gas diffusion electrode are communicated to each other through a pipe, and the upper portion of said electrolytic solution reservoir and a lower portion of said electrolytic cell are communicated to each other through a pipe via a head generator, whereby an electrolytic solution overflowing said electrolytic solution reservoir flows downward toward the lower portion of said electrolytic cell and the amount of the electrolytic solution flowing downward is controlled by changing the height of the liquid level in said reservoir.
5. The sodium chloride electrolytic cell according to the above item 4, wherein a bubbler is provided at the electrolytic solution and oxygen gas discharge ports at the lower portion of said cathode chamber, in which said cathode chamber is pressed by oxygen gas to effect electrolysis.
6. A sodium chloride electrolytic cell comprising, as a space for securing a passage of oxygen, a nickel mesh substance internally fitted in a gas chamber defined by a gas diffusion electrode and a concave portion having the same size as said gas diffusion electrode formed in the central portion of a thin nickel plate by press-molding the thin nickel plate.
7. The sodium chloride electrolytic cell according to the above item 6, wherein said nickel mesh substance is shaped to have a large number of fine corrugations running in the direction perpendicular to a stream of oxygen so that oxygen is agitated by the corrugations to come in uniform contact with said gas diffusion electrode.

In other words, the present invention concerns a gas diffusion electrode comprising a gas chamber in which an electrode sequentially and integrally formed of a hydrophilic porous material, a reactive layer and a gas supply layer is mounted, a gas diffusion electrode comprising, as a spacer for securing the passage of oxygen, a nickel mesh substance internally fitted in the gas chamber, and sodium chloride electrolytic cells comprising these gas diffusion electrodes.

Preferred examples of the electrolytic cell to which these gas diffusion electrodes can be specifically applied are described below.

In a first embodiment of the sodium chloride electrolytic cell according to the invention, as shown in FIG. 1, a cathode portion 2 in an electrolytic cell 1 comprises an ion exchange membrane 3, a cathode chamber 4 as an electrolytic solution passage through which the electrolytic solution flows down, a reactive layer 6 on a gas diffusion electrode 5 which acts as an oxygen cathode, a gas supply layer 7, and a gas chamber 8. Provided inside the cathode chamber 4 through which the electrolytic solution flows down is a hydrophilic porous material 10 having fine open cells. An aqueous solution of caustic soda 11 is supplied into the cathode chamber 4 at a caustic soda inlet 12, and then flows down from the upper portion of the cathode chamber 4 through the hydrophilic porous material 10.

An oxygen gas 14 is supplied into the gas chamber 8 in the gas diffusion electrode 5 at an oxygen gas inlet 15 provided on the upper portion of the gas diffusion electrode 5 at almost the same pressure as in the cathode chamber 4. The amount of the electrolytic solution flowing down through the cathode chamber 4 is controlled by the pore diameter and porosity of the hydrophilic porous material 10 and the thickness of the passage.

As the material constituting the hydrophilic porous material 10 there may be used any metal, metal oxide or organic material so far as it is resistant to corrosion and hydrophilic. The hydrophilic porous material 10 is preferably in the form of longitudinally grooved material, porous material or network arranged to facilitate the downward flow of the electrolytic solution and hence give little increase in the liquid resistance during electrolysis. It is particularly important that the hydrophilic porous material 10 have a shape such that bubbles can hardly reside therein.

The surface of the reactive layer 6 of the gas diffusion electrode 5 is preferably hydrophilic so that bubbles cannot reside therein. The gas diffusion electrode 5 employable herein may be either permeable or impermeable to liquid.

In the present invention, it is important that there be no difference between the pressure of the electrolytic solution in the cathode chamber 4 as the passage of electrolytic solution and the pressure of gas in the gas chamber 8 in the gas diffusion electrode 5. As a means for accomplishing this purpose there is preferably used a means involving the enhancement of the gas pressure in the gas chamber 8 in the gas diffusion electrode 5. In this arrangement, the resulting gas pressure presses the electrolytic solution in the cathode chamber to restrict the downward flow of the electrolytic solution so that the electrolytic solution forms a liquid level at the lower end of the cathode chamber 4 in FIG. 1.

In this case, it is not necessary that an oxygen pressure corresponding to the head of the electrolytic solution column in the cathode chamber be applied. In practice, a sodium chloride electrolytic cell comprising an ion exchange membrane is arranged such that the gap between the ion exchange membrane and the surface of the reactive layer 6 of the gas diffusion electrode 5, i.e., the thickness of the cathode chamber is as small as possible, that is, from about 2 mm to 3 mm to minimize the electrical resistance of the electrolytic cell. Accordingly, the flow resistance developed when the electrolytic solution flows down increases due to the viscosity of the electrolytic solution, etc., preventing the entire head of the electrolytic solution column from directly covering the lower end of the cathode chamber. Therefore, a gas pressure almost corresponding to the head of the electrolytic solution column covering the lower end of the cathode chamber may be applied. If the entire head of the electrolytic solution column directly covers the lower end of the cathode chamber, and the corresponding gas pressure is applied, the gas leaks from the gas diffusion electrode to the cathode chamber at the upper end of the cathode chamber as previously described.

Further, in the present invention, also by arranging the cathode such that the electrolytic solution can freely flow out at the end of the cathode chamber 4 as electrolytic solution passage, there can be easily no difference between the pressure of electrolytic solution and the gas pressure.

In this case, no liquid reservoir is formed at the lower end of the cathode chamber 4. Therefore, even if the cathode chamber 4 is filled with the electrolytic solution which is flowing down, the head of electrolytic solution column doesn't act on the electrolytic solution itself.

In other words, in normal cases, there is provided as a discharge pipe a riser communicating to the lower end of the cathode chamber 4 from which the catholyte overflows or there is provided a throttling valve on the discharge pipe provided at the lower end of the cathode chamber 4 in order to keep the liquid level at the upper end of the cathode chamber 4. In either case, the head of electrolytic solution column acts on the electrolytic solution itself.

In the present invention, when there is provided a free discharge end as previously mentioned, the cathode chamber 4 through which the electrolytic solution flows down is filled with the electrolytic solution which is flowing down. The energy developed by the velocity of downward flow is consumed by the resistance with the ion exchange membrane which the electrolytic solution contacts. Thus, the static pressure developed by the stationary state doesn't act on the ion exchange membrane. However, the cathode chamber 4 is always filled with the electrolytic solution only when the thickness of the cathode chamber 4 is considerably small as previously mentioned, making it possible to form a continuous liquid layer.

By communicating the electrolytic solution and the oxygen gas to each other at the lower end of the cathode chamber 4, the pressure of the electrolytic solution at the lower portion of the cathode chamber 4 and the pressure of oxygen gas at the lower portion of the gas chamber can be easily made equal to each other.

In a second embodiment of the present invention, an electrolytic solution reservoir 17 is provided at the upper portion of the electrolytic cell 1 so that there occurs no pressure differential between the liquid chamber and the gas chamber. The gas phase above the liquid level in the electrolytic solution reservoir 17 and an oxygen gas inlet 15 are communicated to each other through a pipe 18. Further, the upper portion of the electrolytic solution reservoir 17 and the lower chamber 20 of the electrolytic cell are communicated to each other through an overflow pipe 21 via a head generator 22 so that the overflowing electrolytic solution flows down to the lower chamber 20 of the electrolytic cell through the overflow pipe 21 (see FIG. 2).

Thus, the electrolytic solution and the oxygen gas 14 are kept at almost the same pressure. The electrolytic solution and the oxygen gas are separately supplied into the electrolytic cell at the upper portion thereof. Then, the electrolytic solution spontaneously flows down while the oxygen gas comes out from the oxygen gas outlet 16 through a discharge pipe 23 provided at the lower portion of the gas chamber. Since the catholyte and the gas spontaneously flow down with little pressure differential therebetween, the catholyte cannot leak to the gas chamber 8 even if a gas diffusion electrode 5 comprising a gas supply layer 7 having a low water resistance is used.

However, when the operation is effected with both the anolyte and the catholyte being subject to atmospheric pressure, the resulting head pressure of the catholyte presses and brings the ion exchange membrane 3 into contact with the reactive layer 6 of the gas diffusion electrode 5, preventing the catholyte from flowing. In order to avoid this trouble, an arrangement is provided such that a hydrophilic porous material which is permeable to electrolytic solution, can hold electrolytic solution, is little liable to bubbling and cannot be deformed by the pressure developed by the head of the electrolytic solution and thus cannot cut the passage is provided interposed between the ion exchange membrane 3 and the reactive layer 6 of the gas diffusion electrode.

By forming grooves having a depth of from 0.5 to 4 mm and a width of from 0.5 to 4 mm on the electrolytic solution passage and/or reactive layer 6, the flow rate of electrolytic solution and gas can be increased. The amount of the electrolytic solution flowing down can be controlled by changing the height of the liquid level in the electrolytic solution reservoir 17.

In another embodiment of the present invention, an electrode integrally formed of at least a hydrophilic porous material 10 as an electrolytic solution passage portion, a reactive layer 6 and a gas supply layer 7 sequentially as viewed from the surface layer with an electrically conductive porous material as a core as shown in FIG. 4 is mounted in the gas chamber 8. In this arrangement, electrolysis is effected while allowing the electrolytic solution to flow down from the upper portion of the gas diffusion electrode through the electrolytic solution passage 4 with the gap between the ion exchange membrane 3 and the gas diffusion electrode being zero.

FIG. 2 illustrates the structure of an electrolytic cell intended to secure electrical conductivity and gas passage. A bubbler 24 is provided at the gas and electrolytic solution outlet so that the cathode chamber 4 is compressed by the resulting liquid pressure. In this arrangement, the pressure in the cathode chamber 4 is higher than that in the anolyte chamber, causing the ion exchange membrane to be pressed against the anode and hence allowing electrolysis without any spacer. In this case, the gas diffusion electrode 5 and the ion exchange membrane 3 are preferably hydrophilic.

The electrolytic solution reservoir 17 is provided at the upper portion of the electrolytic cell 1 shown in FIG. 2. The gas phase above the liquid level in the electrolytic solution reservoir 17 and the oxygen gas thus supplied 14 are communicated to each other through a gas communicating pipe 18. The upper portion of the electrolytic solution reservoir 17 and the lower portion of the electrolytic cell 1 are communicated to each other through an overflow pipe 21 so that only the overflowing electrolytic solution flows down through the electrolytic solution passage provided at the lower portion of the cathode chamber. If the overflow pipe 21 is directly connected to the lower chamber 20, the chamber of the electrolytic solution reservoir 17 and the lower chamber 20 are kept at the same pressure. Therefore, if the pressure developed by the liquid column in the cathode chamber 4 is applied to the lower chamber 20, the overflow pipe 21 is preferably connected to the lower chamber 20 through the head generator 22 so that it is connected to the lower chamber 20 with a head pressure corresponding to that pressure being applied to the system.

FIG. 3 is a side view illustrating only the portion of the overflow pipe 21 shown in FIG. 2 wherein the head generator 22 is shown at the lower end thereof.

While the electrolytic cell according to the invention shown in FIG. 1 is arranged such that an aqueous solution of caustic soda as an electrolytic solution and oxygen gas are supplied into the electrolytic cell at separate inlets, and then introduced into the respective chambers through the respective passages, it is preferred that the various portions be formed integrally of the electrolytic cell rather than piping as shown in FIG. 7. Another arrangement may be provided such that the gas and the electrolytic solution are supplied into the electrolytic cell at the same inlet, and then introduced into the respective chambers.

The gas diffusion electrode to be used herein is obtained by a process which comprises applying a reactive layer paste made of silver and PTFE to a nickel porous material having 5 ppi plated with silver to a thickness of 3 mm at an area of 11 cm×1 cm, applying a gel obtained by adding ethanol to PTFE dispersion to the coated material, drying the coated material, removing a surface active agent therefrom, drying the coated material, and then subjecting the coated material to heat treatment. Thus, a gas diffusion electrode comprising an electrolytic solution passage having a thickness of about 2 mm, a reactive layer having a thickness of about 0.4 mm and a gas supply layer having a thickness of about 0.6 mm is obtained.

This electrode is arranged comprising the ion exchange membrane 3, the gas diffusion electrode (integrally formed of electrolytic solution passage 4, reactive layer 6 and gas supply layer 7) and gas chamber 8 (see FIG. 2). The aqueous solution of caustic soda 11 flows down from the upper portion of the electrolytic cell 1 through the electrolytic solution passage having the hydrophilic porous material 10. The oxygen gas 14 is supplied into the gas chamber at the oxygen gas inlet 15 at almost the same pressure as the liquid chamber.

As the material constituting the porous core which forms the electrolytic solution passage in the electrode there may be used any electrically conductive corrosion-resistant hydrophilic material. The hydrophilic porous material is preferably in the form of longitudinally grooved material, porous material or network arranged to facilitate the downward flow of the electrolytic solution and hence give little increase in the liquid resistance during electrolysis. It is particularly important that the hydrophilic porous material have a shape such that bubbles can hardly reside therein.

So far as the gas diffusion electrode 5 and ion exchange membrane 3 used are hydrophilic, a spacer is not necessarily required if the pressure of the aqueous solution of caustic soda 11 and oxygen gas 14 supplied can be raised so that the liquid level in the cathode chamber is higher than the liquid level in the anode chamber, causing the ion exchange membrane 3 to be pressed against the anode. The bubbler 24, oxygen gas outlet 16 and caustic soda outlet 13 shown in FIG. 3 are provided to arrange such that the cathode chamber can be compressed by the resulting liquid pressure. It is preferred that the head generator 22 and the bubbler 24 be integrally formed with the electrolytic cell.

In the present invention, for the preparation of the gas diffusion electrode itself, an electrically conductive core material is used to enhance the strength thereof. A reactive layer-forming material or gas supply layer-forming material in paste form can then be pushed into or applied to the electrically conductive core material to prepare the gas diffusion electrode. Since a hydrophilic porous material is provided also on the cathode chamber adjacent to the gas diffusion electrode, it can be proposed that the gas diffusion electrode and the hydrophilic porous material be prepared together.

In other words, FIG. 4 illustrates a gas diffusion electrode 5 comprising a reactive layer 6 and a gas supply layer 7 provided on the entire surface of a metallic porous material 26 which satisfies the requirements for hydrophilic porous material 10.

FIG. 5 illustrates a gas diffusion electrode 5 comprising a reactive layer 6 and a gas supply layer 7. provided inside a metallic porous material 26 on one side thereof and a metallic porous material portion provided outside the gas supply layer 7. The electrically conductive porous material provided outside the gas supply layer 7 forms a part of the porous material in the gas chamber.

FIG. 6 illustrates a gas diffusion electrode 5 comprising a reactive layer 6 and a gas supply layer 7 provided in the central part of the interior of an electrically conductive porous material 26 and a porous material portion provided on the respective sides of the reactive layer 6 and the gas supply layer 7. As viewed in FIG. 6, the upper porous material acts as hydrophilic porous material 10 and the lower porous material acts as porous material 9 in the gas chamber.

An embodiment of the gas chamber in the gas diffusion electrode according to the invention is described below in connection with the drawings. FIG. 8 is a schematic vertical sectional view illustrating the entire structure of the gas chamber in the gas diffusion electrode according to the invention. FIG. 9 is a vertical sectional view illustrating an essential part of the gas chamber of FIG. 8. FIG. 10 is a perspective view illustrating the structure of the corrugated mesh of FIG. 9. Where the same parts are the same as those of FIG. 11, which illustrates a conventional gas diffusion electrode, the same numbers are used.

The oxygen cathode 40 to be used as a cathode in the electrolysis of sodium chloride using the ion exchange membrane process according to the invention comprises a gas chamber 34 formed between the gas diffusion electrode 31 and a thin nickel plate 38 having a concave portion 39 having the same dimension as the gas diffusion electrode 31 formed by press-molding as shown in FIGS. 8 and 9. In the gas chamber 34 is internally fitted a nickel mesh substance 37 as a spacer for securing the passage of oxygen. The mesh substance 37 may be a metal gauze or a stack of metal gauzes. The mesh substance 37 is preferably configured to have a large number of fine corrugations running in the direction perpendicular to the stream of oxygen so that oxygen is thoroughly agitated by the corrugations to come in uniform contact with the gas diffusion electrode 31. The mesh substance 37 needs to have a thickness of from 0.1 to 5 mm to secure the desired flow velocity of oxygen and lower the resistance.

The term "mesh substance" as used herein is not a general term. However, since the term "metal gauze", which is normally used, means a restricted structure and can hardly encompasses "corrugated mesh" in its scope, the term "mesh substance" is used in the invention.

Since the same numbers are used where the parts have the same function as the cathode chamber in the conventional electrolytic cell described in FIG. 11, repeated description of those parts is omitted.

The gas chamber in the gas diffusion electrode according to the invention is configured as mentioned above. Accordingly, in the case where sodium chloride is electrolyzed in an electrolytic cell comprising the gas diffusion electrode according to the invention, the linear velocity of oxygen gas flowing through the mesh is raised because the mesh is internally fitted in the gas chamber, inevitably reducing the inner capacity of the gas chamber. At the same time, oxygen gas is thoroughly agitated by the corrugated mesh so that it can come in uniform contact with the gas diffusion electrode. In this manner, sufficiently satisfactory oxygen reduction reaction takes place on the gas diffusion electrode, lowering the cathode potential and hence remarkably lowering the required electrolysis voltage. In particular, when a corrugated mesh is used, the linear velocity of oxygen gas flowing therethrough is further enhanced. At the same time, oxygen gas is thoroughly agitated by the corrugated mesh, making it possible for oxygen gas to come in uniform contact with the gas diffusion electrode.

BEST MODE FOR CARRYING OUT THE INVENTION

Figure 1:
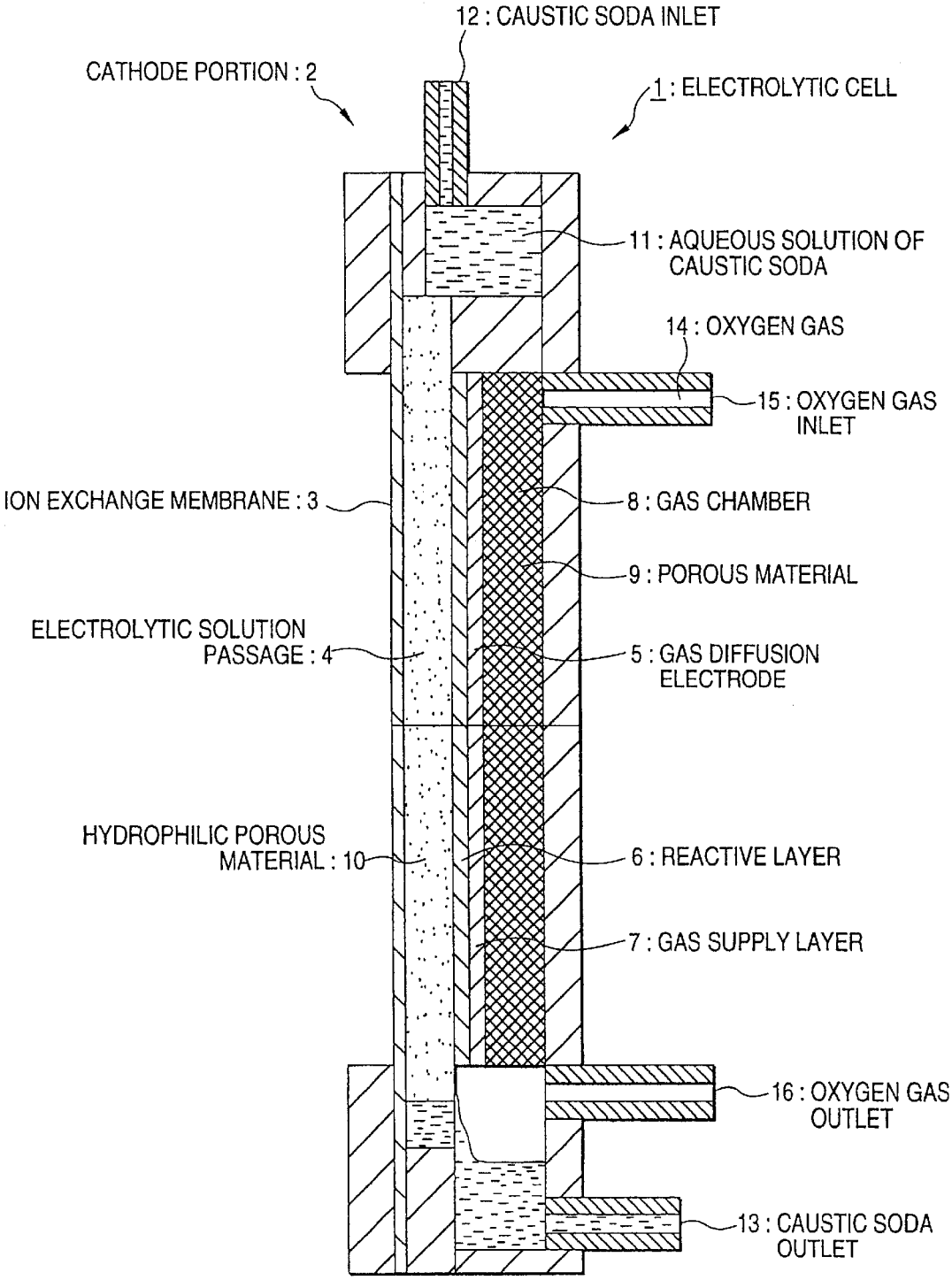
FIG. 1 is a sectional diagram illustrating an embodiment of the electrolytic cell according to the present invention.

The present invention will be described in greater detail with reference to the following Examples. However, the present invention should not be construed as being limited to these examples. Throughout the Examples, all the "parts" and "%" are meant to indicate "parts by weight" and "% by weight", respectively.

EXAMPLE 1

To 5 parts (hereinafter by weight) of particulate silver (Ag-3010, produced by Mitsui Mining & Smelting Co., Ltd.; average particles diamter: 0.11 $\mu$m) were added 1 part of Triton as a surface active agent and 9 parts of water. The mixture was then subjected to dispersion by means of an ultrasonic disperser. To the dispersion thus prepared was then added 1 part of PTFE dispersion (D-1, produced by DAIKIN INDUSTRIES, LTD.). The mixture was then stirred. To the mixture were then added 2 parts of ethanol. The mixture was then stirred so that it was self-organized. The resulting precipitate was filtered through a filter paper having a pore diameter of 1 $\mu$m to obtain a slurry.

To a silver-plated nickel foamed product (produced by Japan Metals & Chemicals Co., Ltd.; thickness: 3.7 mm; size: 10 cm×20 cm) into which a paste obtained by adding PTFE dispersion (D-1, produced by DAIKIN INDUSTRIES, LTD.) as gas supply layer had been previously pushed was then applied the foregoing slurry to a thickness of 0.3 mm. The slurry was then pressed into the foamed product under a pressure of 10 kg/cm$^2$ to form a reactive layer and a gas supply layer therein. The foamed product was then dried at a temperature of 80° C. for 3 hours. The surface active agent was then removed by an extractor with ethanol. The foamed product was then dried at a temperature of 100° C. for 2 hours to obtain a gas diffusion electrode. The amount of particulate silver used was 430 g/m$^2$.

The gas diffusion electrode thus obtained was then mounted on a silver-plated electrode frame. A 50 ppi nickel foamed product having a thickness of 1.5 mm was then laminated on the electrode to form an electrolytic solution passage.

The gas diffusion electrode thus obtained was mounted in an ion exchange membrane electrolytic cell shown in FIG. 1. The anolyte pressure was then kept at a water-gauge pressure of 100 mm so that the gas diffusion electrode was allowed to come in contact with the nickel foamed product as electrolytic solution passage. A 32% aqueous solution of caustic soda was allowed to flow down from the upper portion of the electrolytic cell at a rate of 50 ml per minute. Oxygen gas was allowed to flow through the gas chamber at almost the same pressure as the aqueous solution of caustic soda in an amount of 1.5 times the theoretical value. Thereafter, electric current was supplied into the electrolytic cell.

As a result, when a 32% aqueous solution of NaOH was supplied at a temperature of 90° C., an electrolytic cell voltage of 2.05 V with a current density of 30 A/dm$^2$ was obtained. The electrolytic solution which had flown down through the passage joined excess oxygen gas, and then was discharged from the electrolytic cell at the lower outlet.

EXAMPLE 2

A gas diffusion electrode made of carbon having silver supported thereon was prepared. The gas diffusion electrode thus prepared was mounted on a gas chamber having a nickel mesh laminated thereon. A micromesh produced by Katsurada Expanded Metal Co., Inc. (0.2 Ni, 0.8-M60, thickness: 1 mm) was then provided interposed between an ion exchange membrane and the gas diffusion electrode to form an electrolytic solution passage. The operation was then effected under the same conditions as in Example 4 with a 32% aqueous solution of caustic soda being allowed to flow down at a rate of 90 ml per minute. As a result, an electrolytic cell voltage of 2.11 V was obtained when the operation was effected with a 32% aqueous solution of NaOH at a current density of 30 A/dm$^2$ and a temperature of 90° C. with oxygen being supplied in an amount of 1.6 times the theoretical value.

EXAMPLE 3

A gas diffusion electrode made of carbon having platinum supported thereon was prepared. The gas diffusion electrode thus prepared was mounted on a gas chamber having a nickel mesh laminated thereon. A corrugated nickel micromesh (0.2 Ni, 0.8-M30, thickness: 1 mm) was then provided interposed between an ion exchange membrane and the gas diffusion electrode to form an electrolytic solution passage. The operation was then effected under the same conditions as in Example 4 with a 32% aqueous solution of caustic soda being allowed to flow down at a rate of 120 ml per minute. As a result, an electrolytic cell voltage of 2.06 V was obtained when the operation was effected with a 32% aqueous solution of NaOH at a current density of 30 A/dm$^2$ and a temperature of 90° C. with oxygen being supplied in an amount of 1.6 times the theoretical value.

EXAMPLE 4

Figure 2:
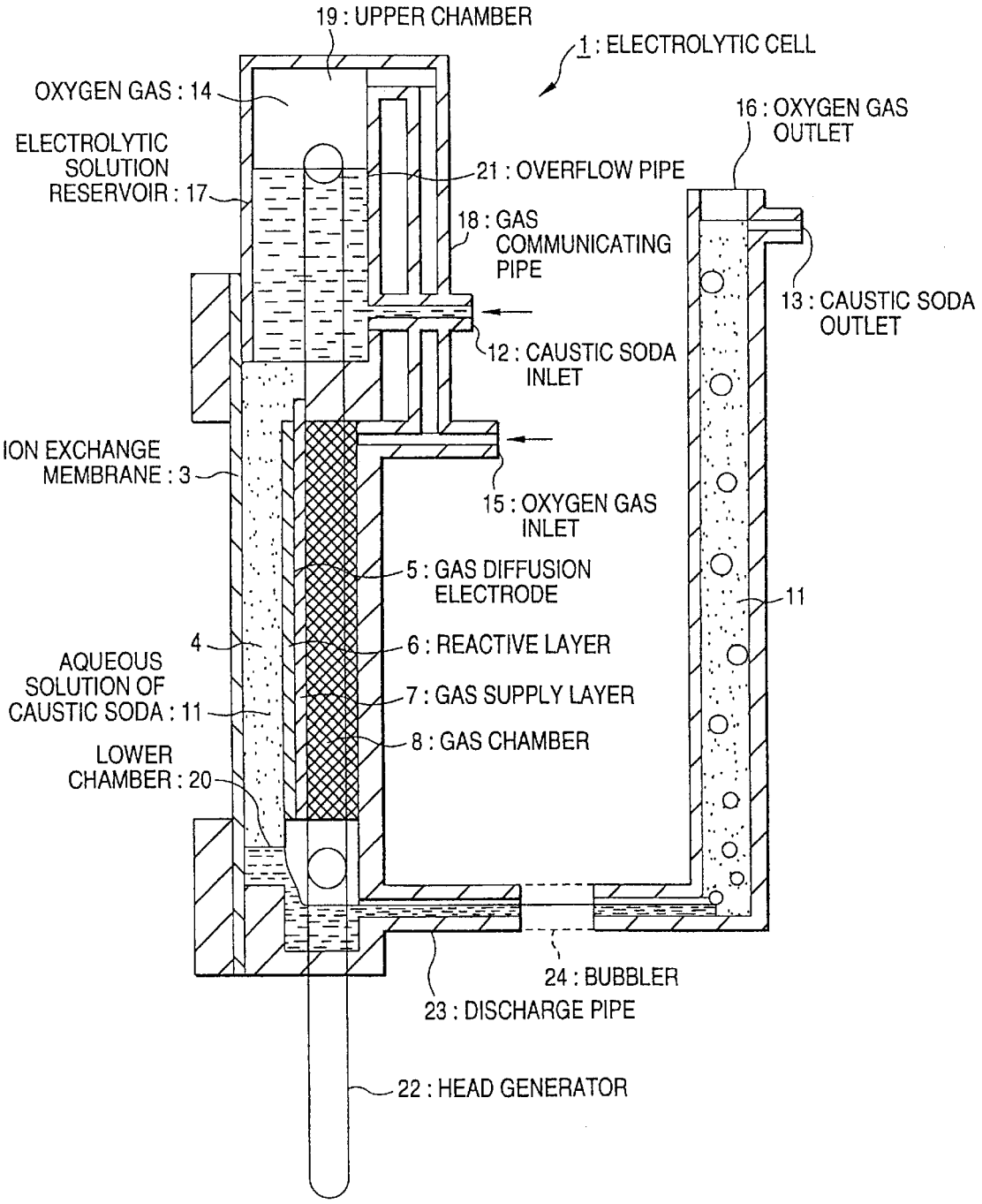
FIG. 2 is a sectional diagram illustrating an embodiment of the electrolytic cell according to the present invention comprising an electrolytic solution reservoir provided therein.
Figure 3:
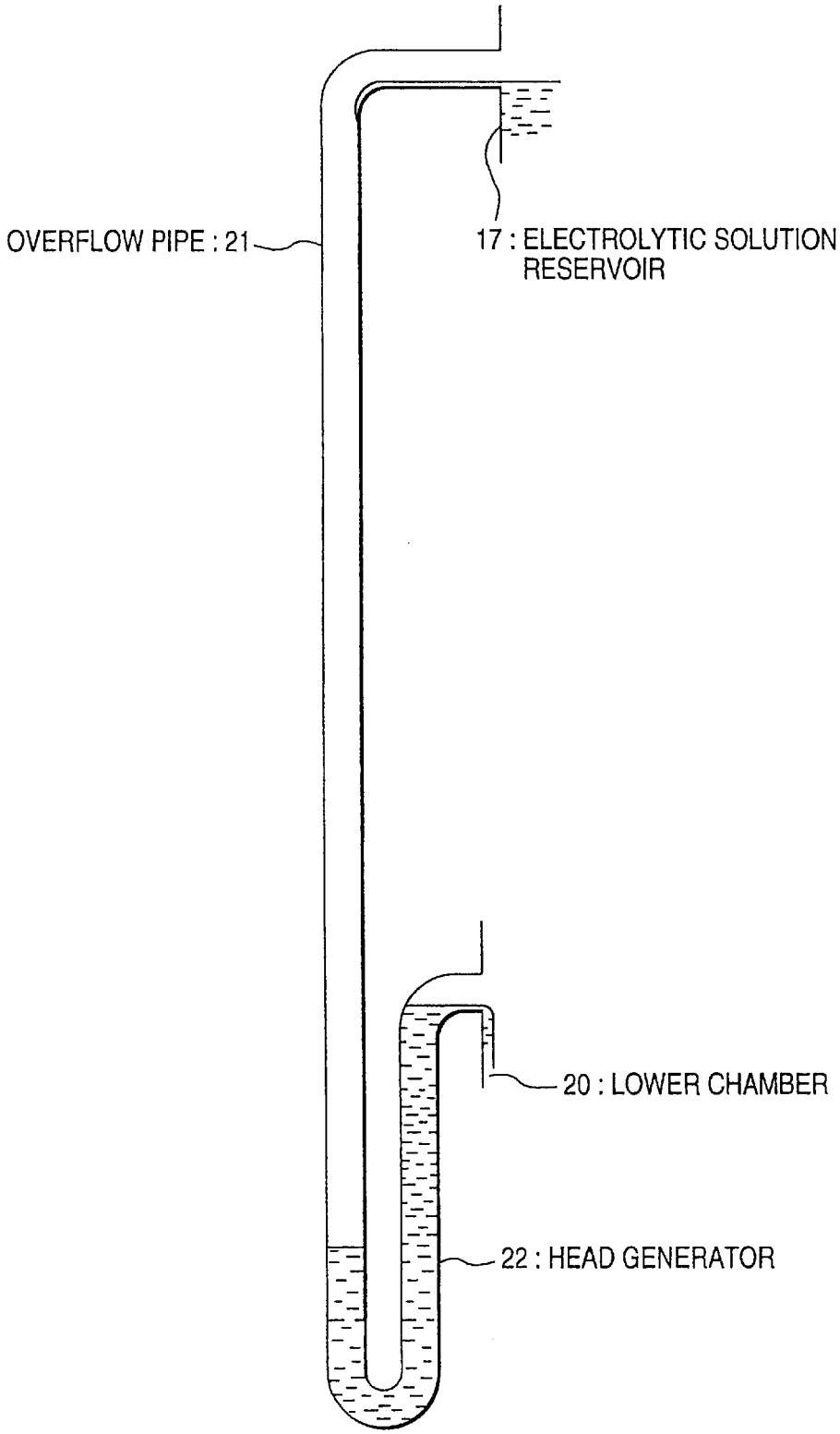
FIG. 3 is a side view illustrating the portion of overflow pipe in the electrolytic cell of FIG. 2.
Figure 4:
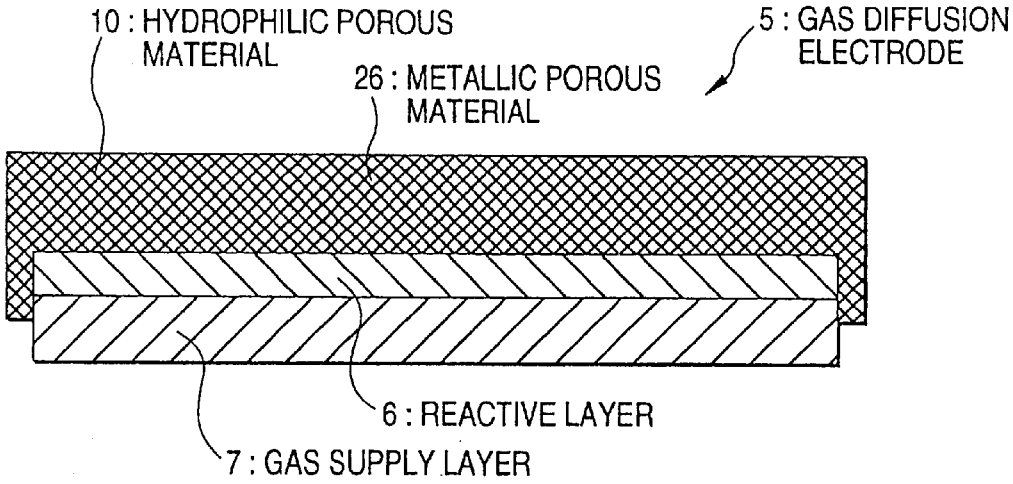
FIG. 4 is a sectional diagram illustrating an embodiment of the gas diffusion electrode integrally formed of electrolytic solution passage, reactive layer and gas supply layer with an electrically conductive porous material as a core.
Figure 5:
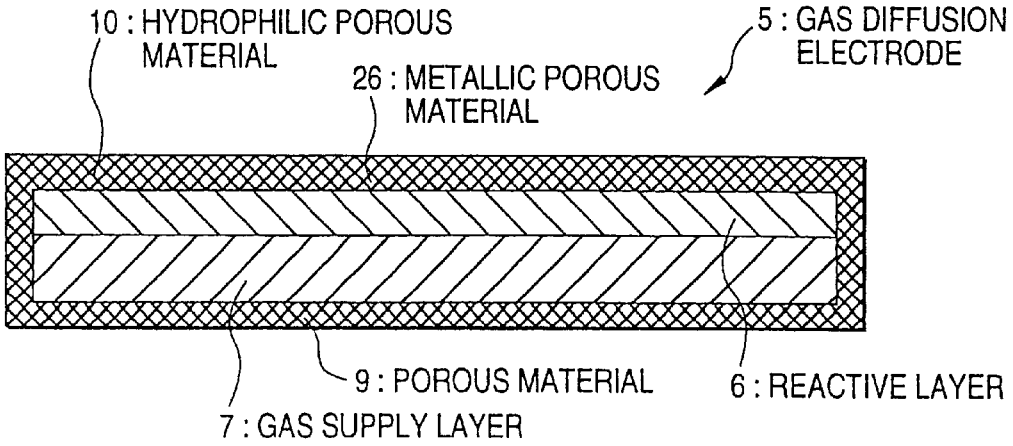
FIG. 5 is a sectional diagram illustrating an embodiment of the gas diffusion electrode integrally formed of electrolytic solution passage for securing electrical conductance and gas passage, reactive layer and gas supply layer.
Figure 6:
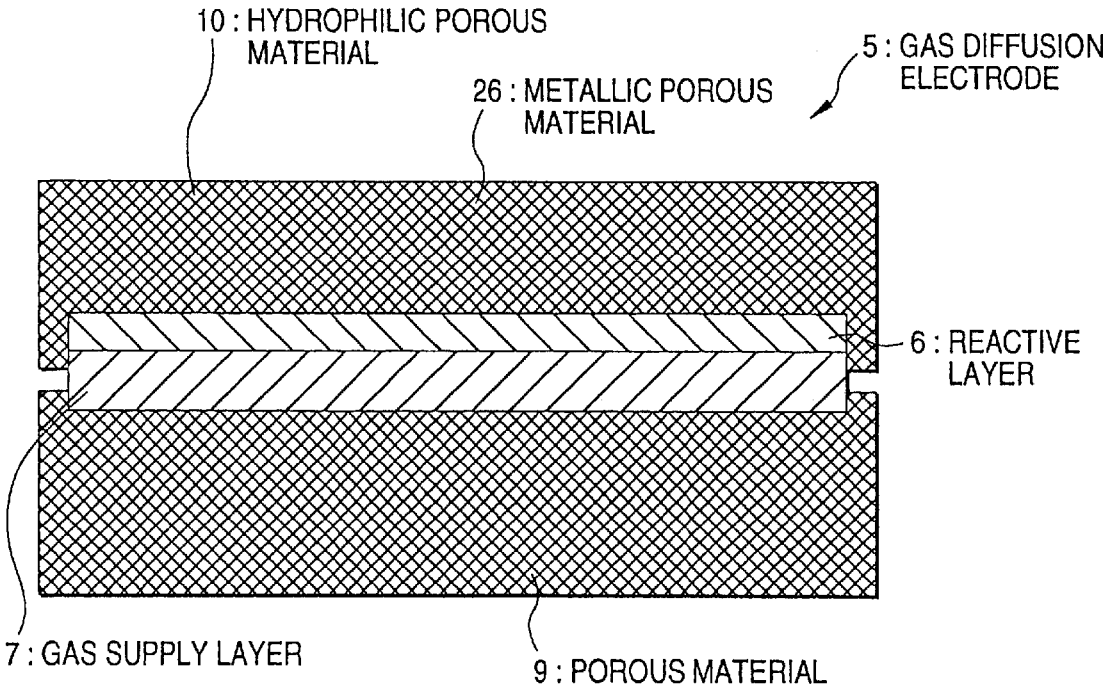
FIG. 6 is a sectional diagram illustrating an embodiment of the structure comprising a gas chamber and a gas diffusion electrode connected to each other via an electrically conductive supply layer.
Figure 7:
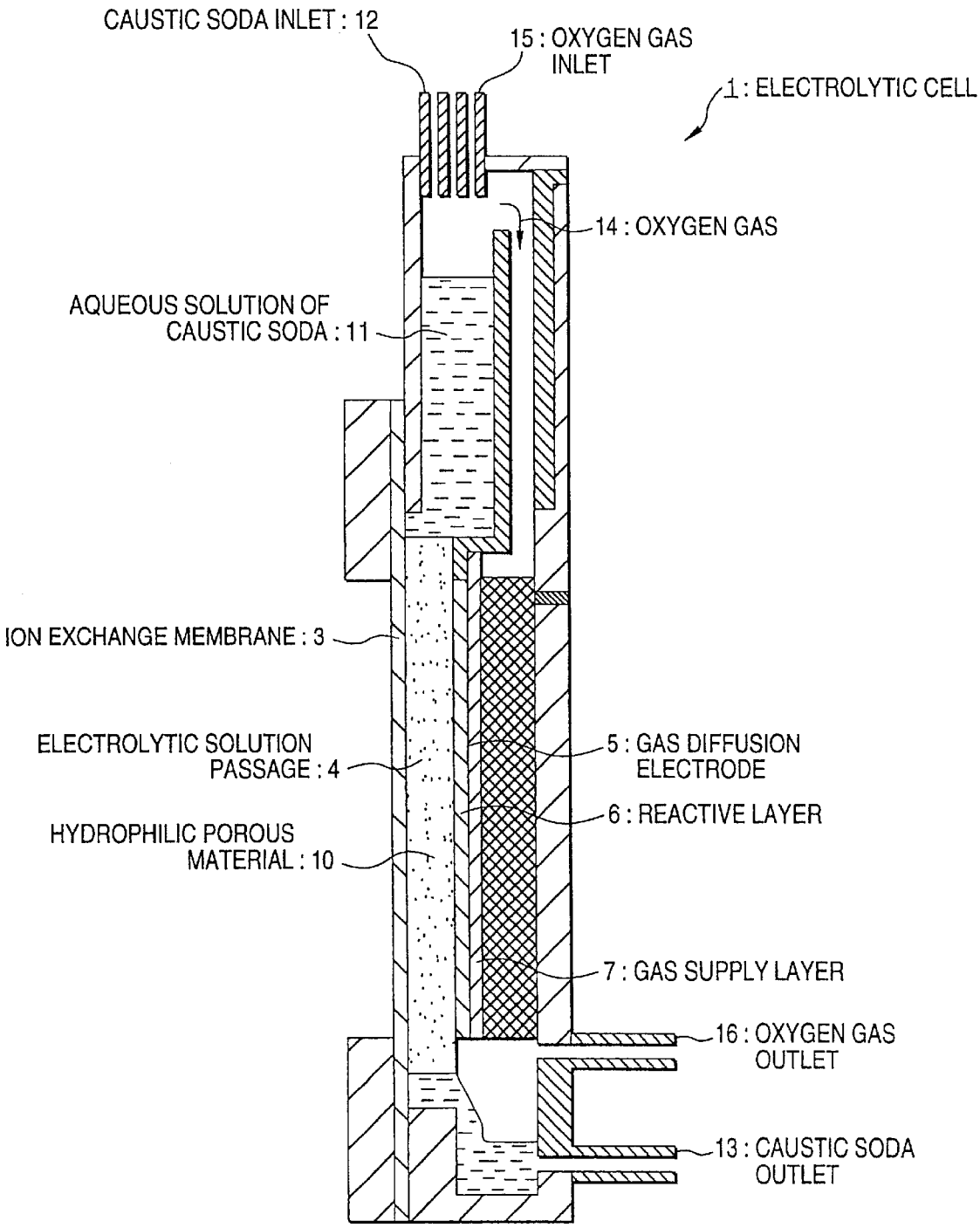
FIG. 7 is a sectional diagram illustrating another embodiment of the electrolytic cell according to the invention comprising an electrolytic solution reservoir provided therein.

An electrolytic cell was provided comprising an electrolytic solution reservoir provided at the upper portion thereof, the gas phase above the liquid level in the electrolytic solution reservoir and the gas supplied being communicated to each other through a pipe, the upper portion of the electrolytic solution reservoir and the lower portion of the electrolytic cell being communicated to each other through a pipe, as shown in FIG. 2. In this arrangement, the overflowing electrolytic solution flows down to the lower portion of the electrolytic cell. No bubbler was provided.

Referring to the preparation of the gas diffusion electrode used, to 5 parts of particulate silver (Ag-3010, produced by Mitsui Mining & Smelting Co., Ltd.; average particle diameter: 0.11 $\mu$m) were added 1 part of Triton as a surface active agent and 9 parts of water. The mixture was then subjected to dispersion by means of an ultrasonic disperser. To the dispersion thus obtained was then added 1 part of PTFE dispersion (D-1, produced by DAIKIN INDUSTRIES, LTD.). The mixture was then stirred. To the mixture was then added 2 parts of ethanol. The mixture was then stirred so that it was self-organized. The resulting precipitate was filtered through a filter paper having a pore diameter of 1 $\mu$m to obtain a slurry. The slurry was then applied to a silver-plated nickel foamed product (produced by Japan Metals & Chemicals Co., Ltd.; thickness: 3.7 mm; size: 10 cm×20 cm) to a thickness of 0.3 mm to form a reactive layer thereon. To the foamed product was immediately applied a gas supply layer-forming paste obtained by adding ethanol to PTFE dispersion (D-1, produced by DAIKIN INDUSTRIES, LTD.). The PTFE dispersion thus applied was then pressed into the foamed product under a pressure of 10 kg/cm$^2$ to form a gas supply layer. The foamed product was then dried at a temperature of 80° C. for 3 hours. The surface active agent was then removed from the foamed product using an extractor with ethanol. The foamed product was dried at a temperature of 80° C. for 2 hours, and then subjected to heat treatment at a temperature of 230° C. for 10 minutes to obtain an electrode. The amount of particulate silver used was 430 g/m$^2$.

The electrode thus obtained was then mounted on a silver-plated electrode frame having a gas chamber. An ion exchange membrane was then provided interposed between the electrodes to assemble an electrolytic cell. The anolyte pressure was then kept at a water-gauge pressure of 100 mm so that the gas diffusion electrode was allowed to come in contact with the nickel foamed product as electrolytic solution passage. A 32% aqueous solution of caustic soda was allowed to flow down from the upper portion of the electrolytic cell at a rate of 50 ml per minute. Oxygen gas was allowed to flow through the gas chamber at almost the same pressure as the aqueous solution of caustic soda in an amount of 1.5 times the theoretical value. The resulting waste gas was released to the atmosphere.

As a result, when a 32% aqueous solution of NaOH was supplied at a temperature of 90° C., an electrolytic cell voltage of 2.05 V with a current density of 30 A/dm$^2$ was obtained.

EXAMPLE 5

An electrolytic cell was provided having the same structure as that of Example 4 but comprising a bubbler provided at the gas and electrolytic solution outlets by which the cathode chamber is compressed under liquid pressure.

A gas diffusion electrode made of hydrophilic carbon black having silver supported thereon (AB-12), hydrophobic carbon black (No. 6) and PTFE dispersion (D-1, produced by DAIKIN INDUSTRIES, LTD.) was then mounted on the electrolytic cell with a nickel corrugate which acts as a gas chamber to assemble an ion exchange membrane process electrolytic cell. The bubbler used was arranged to have a depth of 40 cm. A 32% aqueous solution of caustic soda was supplied at a rate of 200 ml per minute. The excess electrolytic solution was allowed to overflow.

The operation was effected under the same conditions as in Example 4. As a result, an electrolytic cell voltage of 1.96 V was obtained when the operation was effected with a 32% aqueous solution of NaOH at a current density of 30 A/dm$^2$ and a temperature of 90° C. with oxygen being supplied in an amount of 1.6 times the theoretical value.

EXAMPLE 6

Figure 8:
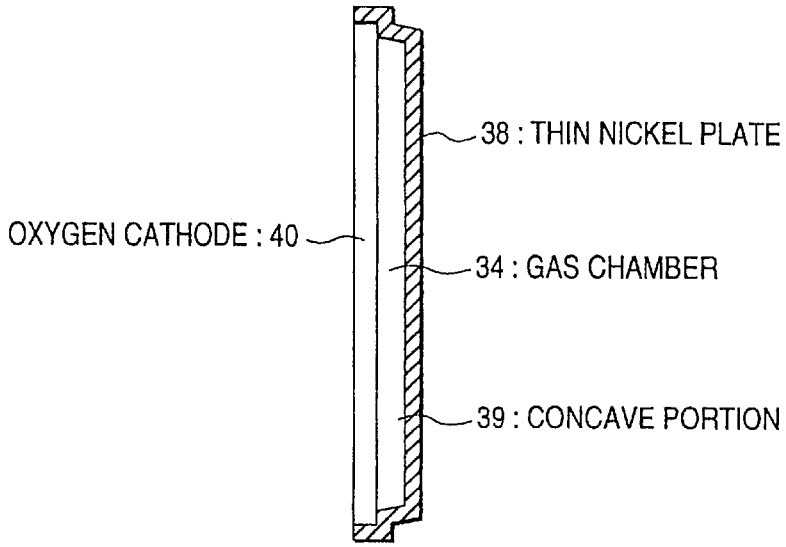
FIG. 8 is a sectional diagram illustrating an embodiment of the entire structure of the gas chamber in the gas diffusion electrode according to the invention.
Figure 9:
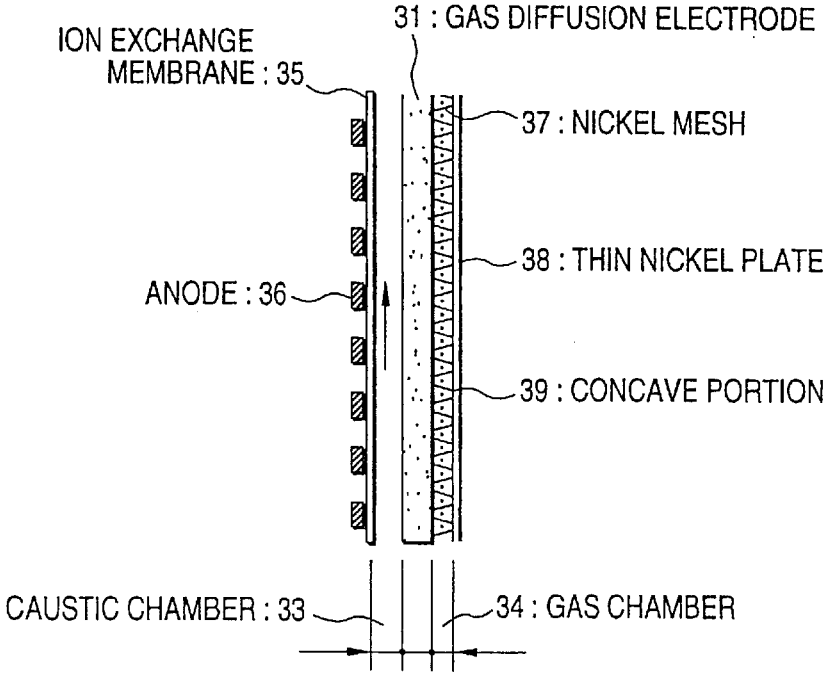
FIG. 9 is a sectional diagram illustrating an essential part of the structure of the gas chamber in the gas diffusion electrode according to the invention.
Figure 10:
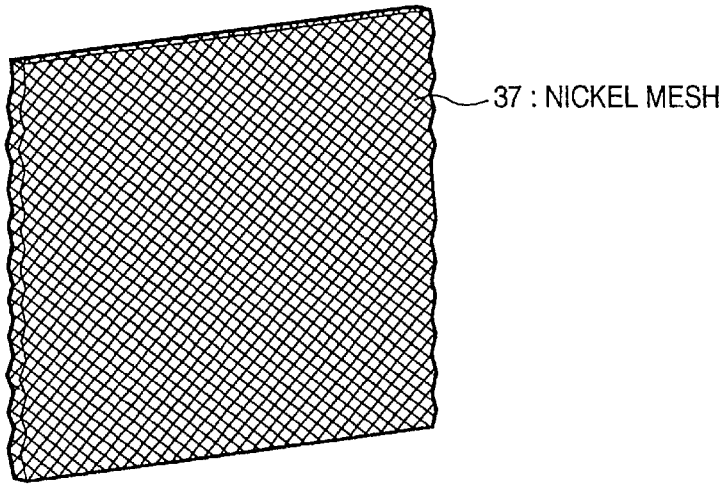
FIG. 10 is a perspective view illustrating the corrugated mesh structure of the nickel mesh substance shown in FIG. 9.
Figure 11:
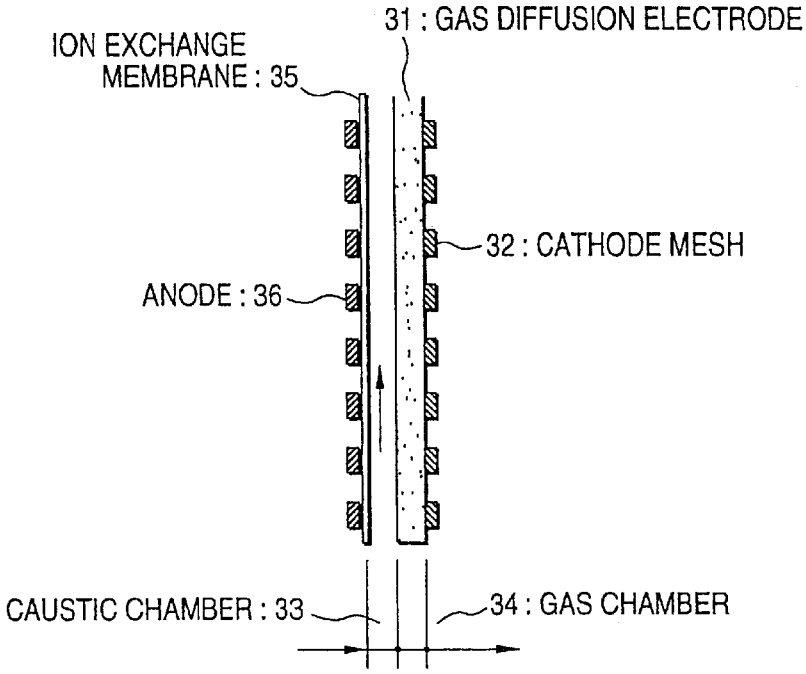
FIG. 11 is a sectional diagram illustrating an embodiment of the structure of the gas chamber in the conventional gas diffusion electrode.

Using gas diffusion electrodes of the invention having the structures shown in FIGS. 8 and 9, tests were conducted with the following specification of electrolytic cell under the following operating conditions. As a result, an electrolysis voltage of as remarkably low as 2.01 V was required.

Dimension of reaction area: 100×600 mm (reaction area: 75 dm$^2$)

Anode: DSE (produced by Permelec Electrode Ltd.)

Cathode: Gas diffusion electrode

Ion exchange membrane: Flemion 893 (produced by Asahi Glass Co., Ltd.)

Electrolysis current density: 30 A/dm$^2$

Operating temperature: 90° C.

Caustic concentration: 32 wt-% NaOH

Sodium chloride concentration: 210 g/l·NaCl

INDUSTRIAL APPLICABILITY

In accordance with the present invention, the use of the electrolytic cell of the invention arranged such that there occurs no pressure differential between the electrolytic solution passage in the cathode chamber and the gas chamber in the gas diffusion electrode causes the resulting caustic soda to be discharged downward together with the descending liquid flow and oxygen gas to be supplied at almost the same pressure as that in the electrolytic solution passage, causing no pressure differential in the vertical direction between the liquid side and the gas side of the gas supply layer. In this arrangement, there is no necessity for providing a perfect countermeasure against the leakage of electrolytic solution from the liquid side to the gas chamber in the gas diffusion electrode. This effect becomes remarkable particularly when a gas diffusion electrode comprising a nickel foamed product as a core is used.

Any possible leakage of electrolytic solution to the gas chamber is insignificant and thus has no adverse effect on the operational performance. Since the flow rate of electrolytic solution can be adjusted by the opening diameter, percent opening and thickness of the passage, the concentration of caustic soda thus produced can be easily controlled. In particular, a gas diffusion electrode which has heretofore not been able to be used because the gas supply layer contained therein has small fine hydrophobic pores and thus causes liquid leakage even at a small pressure differential can be used.

Further, the gas diffusion electrode according to the invention comprises as a spacer for securing the passage of oxygen, a nickel mesh substance provided in an extremely thin flat box-shaped gas chamber formed between a cathode frame made of thin nickel plate having a concave portion formed by press-molding and the gas diffusion electrode. Thus, the gas chamber has a reduced inner capacity that enhances the linear rate of oxygen gas flowing through the mesh and causes oxygen gas to be thoroughly agitated by the mesh. The use of the foregoing gas diffusion electrode makes it possible to allow oxygen to come in uniform contact with the gas diffusion electrode. Accordingly, extremely good oxygen reduction reaction takes place on the gas diffusion electrode, lowering the cathode potential and hence remarkably lowering the required electrolysis voltage.

What is claimed is:

1. A sodium chloride electrolytic cell comprising an anode chamber having an anode into which an aqueous solution of sodium chloride is supplied and a cathode chamber having a cathode comprising a gas diffusion electrode for producing an alkaline aqueous solution, said anode chamber and said cathode chamber being divided by an ion exchange membrane, wherein an electrolytic solution passage is provided between said ion exchange membrane and a reactive layer of said gas diffusion electrode, and wherein a feed opening for said electrolytic solution passage is provided and a feed opening for oxygen gas is provided on an upper portion of a gas chamber of said gas diffusion electrode, through which an electrolytic solution and oxygen gas are separately supplied, so as not to cause pressure differential between said passage and said gas chamber, and then allowed to run downward as descending flow to effect electrolysis, and wherein a hydrophilic structure having open cells and a high porosity is interposed between said ion exchange membrane and said reactive layer of said gas diffusion electrode, and the electrolytic solution is supplied into said electrolytic solution passage having said hydrophilic structure.

2. The sodium chloride electrolytic cell according to claim 1 comprising an electrically conductive porous material as a core, which has at least an electrolytic solution passage portion, a reactive layer and a gas supply layer, sequentially and integrally formed from the surface side.

3. The sodium chloride electrolytic cell according to claim 1, having a structure such that an electrolytic solution reservoir is provided on an upper portion of said electrolytic cell, a gas phase above a liquid level in said electrolytic solution reservoir and the oxygen gas supplied into said gas diffusion electrode are communicated to each other through a pipe, and the upper portion of said electrolytic solution reservoir and a lower portion of said electrolytic cell are communicated to each other through a pipe via a head generator, whereby an electrolytic solution overflowing said electrolytic solution reservoir flows downward toward the lower portion of said electrolytic cell and the amount of the electrolytic solution flowing downward is controlled by changing the height of the liquid level in said reservoir.

4. The sodium chloride electrolytic cell according to claim 3, wherein a bubbler is provided at the electrolytic solution and oxygen gas discharge ports at the lower portion of said cathode chamber, in which said cathode chamber is pressed by oxygen gas to effect electrolysis.

5. A sodium chloride electrolytic cell as claimed in claim 1, further comprising, as a space for securing a passage of oxygen, a nickel mesh substance internally fitted in a gas chamber defined by a gas diffusion electrode and a concave portion having the same size as said gas diffusion electrode formed in the central portion of a thin nickel plate by press-molding the thin nickel plate.

6. The sodium chloride electrolytic cell according to claim 5, wherein said nickel mesh substance is shaped to have a large number of fine corrugations running in the direction perpendicular to a stream of oxygen so that oxygen is agitated by the corrugations to come in uniform contact with said gas diffusion electrode.

* * * * *